US009839950B2

(12) United States Patent
Robbins

(10) Patent No.: US 9,839,950 B2
(45) Date of Patent: Dec. 12, 2017

(54) DUMMY BLOCK FOR EXTRUSION PRESS

(71) Applicant: Exco Technologies Limited, Markham (CA)

(72) Inventor: Paul Henry Robbins, Port Perry (CA)

(73) Assignee: EXCO TECHNOLOGIES LIMITED, Markham (CA)

( * ) Notice: Subject to any disclaimer, the term of this patent is extended or adjusted under 35 U.S.C. 154(b) by 85 days.

(21) Appl. No.: 14/718,858

(22) Filed: May 21, 2015

(65) Prior Publication Data

US 2015/0336148 A1 Nov. 26, 2015

Related U.S. Application Data

(60) Provisional application No. 62/001,958, filed on May 22, 2014.

(51) Int. Cl.

| | |
|---|---|
| ***B21C 26/00*** | (2006.01) |
| ***B21C 33/00*** | (2006.01) |
| ***B21C 23/04*** | (2006.01) |

(52) U.S. Cl.
CPC ..... *B21C 26/00* (2013.01); *B21C 23/04* (2013.01); *B21C 33/00* (2013.01)

(58) Field of Classification Search
CPC ..... B21C 26/00; B21C 35/04; B21C 25/04; B21C 23/218; B21C 25/00; B21C 27/00; B21C 31/00; B21C 33/00; B21C 23/21; B21C 25/06; B21C 27/04; B21C 23/04; B21C 25/02; B21C 35/00; B21C 35/06; B21C 43/00
See application file for complete search history.

(56) References Cited

U.S. PATENT DOCUMENTS 5,918,498 A * 7/1999 Robbins ..... B21C 26/00 72/273

FOREIGN PATENT DOCUMENTS

DK WO 03099480 A1 * 12/2003 ..... B21C 26/00
WO WO 03099480 A1 * 12/2003

OTHER PUBLICATIONS

WO 03099480 A1 from East is attached.*
WO 03099480 A1 is attched.*

* cited by examiner

*Primary Examiner* — Peter DungBa Vo
*Assistant Examiner* — John S Lowe
(74) *Attorney, Agent, or Firm* — Young Basile Hanlon & MacFarlane, P.C.

(57) ABSTRACT

A dummy block for a metal extrusion press comprises a base having a first surface; an expandable collar seated against the base; a moveable plunger coupled to the base and accommodated by the collar, the plunger having a second surface configured to abut against the first surface of the base; and an outer connecting ring coupling the collar to the base. The connecting ring comprises at least one feature engaging the base and a plurality of fingers engaging the collar.

16 Claims, 5 Drawing Sheets

DUMMY BLOCK FOR EXTRUSION PRESS

CROSS-REFERENCE TO RELATED APPLICATION

This application claims the benefit of provisional U.S. Application No. 62/001,958 filed on May 22, 2014, the content of which is incorporated herein by reference in its entirety.

FIELD

The present invention relates generally to extrusion and in particular, to a dummy block for an extrusion press.

BACKGROUND

Metal extrusion presses are known in the art, and are used for forming extruded metal products having cross-sectional shapes that generally conform to the shape of the extrusion dies used. A typical metal extrusion press comprises a generally cylindrical container having an outer mantle and an inner tubular liner. The container serves as a temperature controlled enclosure for a billet during extrusion. An extrusion ram is positioned adjacent one end of the container. The end of the extrusion ram abuts a dummy block, which in turn abuts the billet allowing the billet to be advanced through the container. An extrusion die is positioned adjacent the opposite end of the container.

During operation, once the billet is heated to a desired extrusion temperature (typically 800-900° F. for aluminum), it is delivered to the extrusion press. The extrusion ram and dummy block are then advanced, so as to push the billet through the container and towards the extrusion die. Under the pressure exerted by the advancing extrusion ram and dummy block, the billet is extruded through the profile provided in the extrusion die until all or most of the billet material is pushed out of the container, resulting in the extruded product.

Dummy blocks for extrusion presses have been previously described. For example, U.S. Pat. No. 5,918,498 to Robbins discloses a dummy block having a dummy block base, a connector for connecting the dummy block base to a stem of an extruder, a replaceable wear ring connected to a forward circumferential portion of the dummy block base, a device for releasably securing the wear ring to the dummy block base, and a device for expanding the ring to engage an inside wall of a container of an extrusion press during extrusion. The wear ring is a metal collar having a conical interior surface converging towards the dummy block base. The device for expanding the ring comprises a metal plunger having a plunger head with a conical surface for engaging the collar conical surface to expand the collar as the plunger head is forced into the collar during extrusion. The converging surfaces of the collar and the plunger head extend a sufficient distance to permit telescoping of the plunger head into the collar to an extent whereby the collar is expanded to engage the inside wall of the container.

Improvements are generally desired. It is therefore an object at least to provide a novel dummy block for an extrusion press.

SUMMARY

In one aspect, there is provided a dummy block for a metal extrusion press comprising: a base having a first surface; an expandable collar seated against the base; a moveable plunger coupled to the base and accommodated by the collar, the plunger having a second surface configured to abut against the first surface of the base; and an outer connecting ring coupling the collar to the base, the connecting ring comprising at least one feature engaging the base and a plurality of fingers engaging the collar.

In one embodiment, each finger is received by a corresponding recess of the collar.

The at least one feature may be an inwardly extending circumferential rib. The circumferential rib may be received by a groove on an outer surface of the base.

The plunger may comprise a convex face configured to abut against a billet during use.

The base may comprise a recess configured to receive a portion of a stud. The stud may comprise an internal conduit that is configured to convey fluid into the recess for cooling the dummy block.

The connecting ring may comprise a cut extending therethrough.

The dummy block may be used in a metal extrusion press for carrying out metal extrusion.

There is also provided an extrusion press comprising the dummy block.

BRIEF DESCRIPTION OF THE DRAWINGS

Embodiments will now be described more fully with reference to the accompanying drawings in which.

DETAILED DESCRIPTION OF EMBODIMENTS

Figure 1:
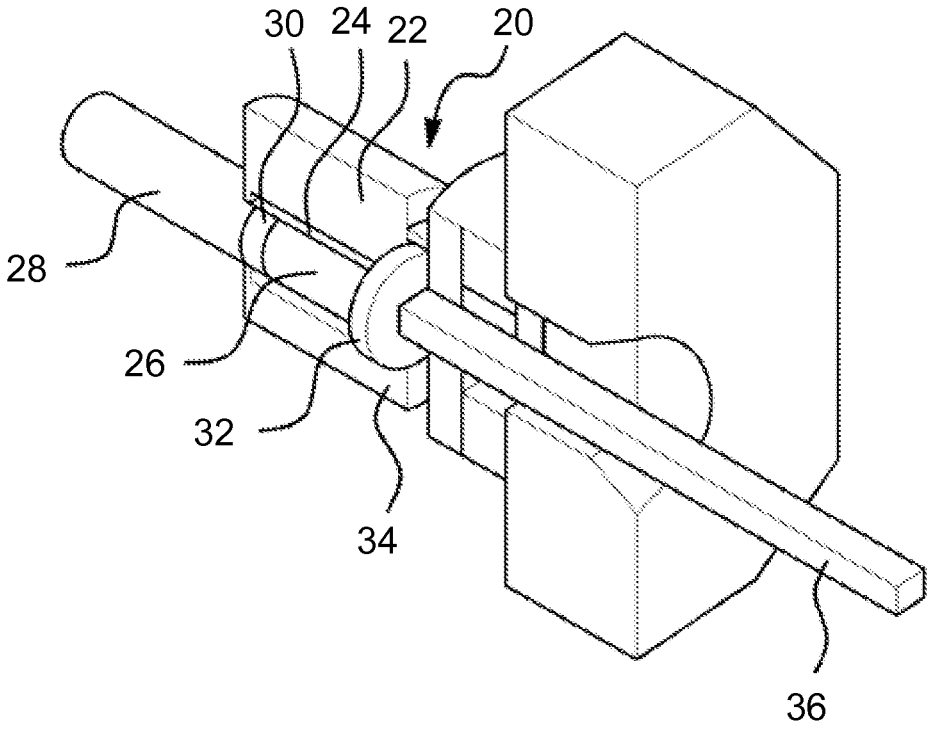
FIG. 1 is a schematic perspective view of a metal extrusion press.
Figure 2:
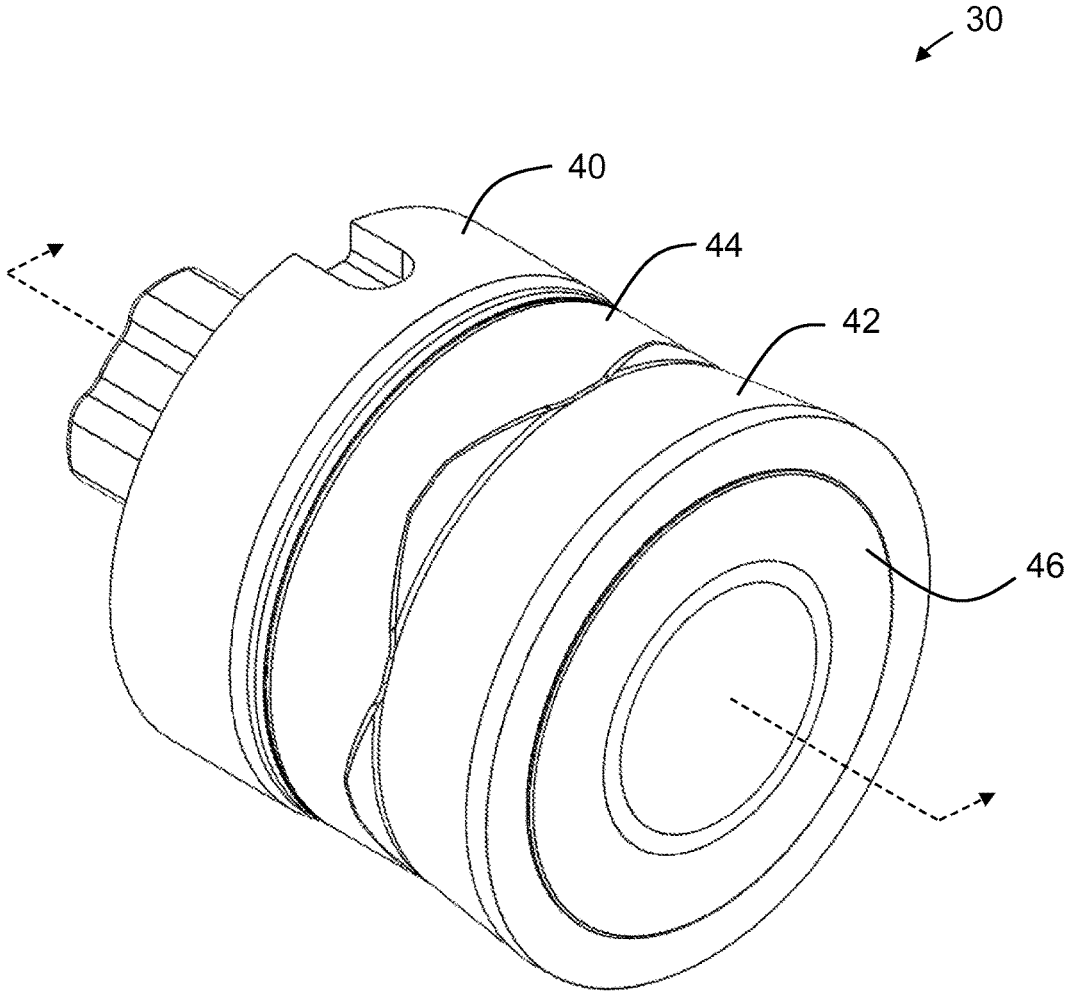
FIG. 2 is a perspective view of a dummy block forming part of the metal extrusion press of FIG. 1.
Figure 3:
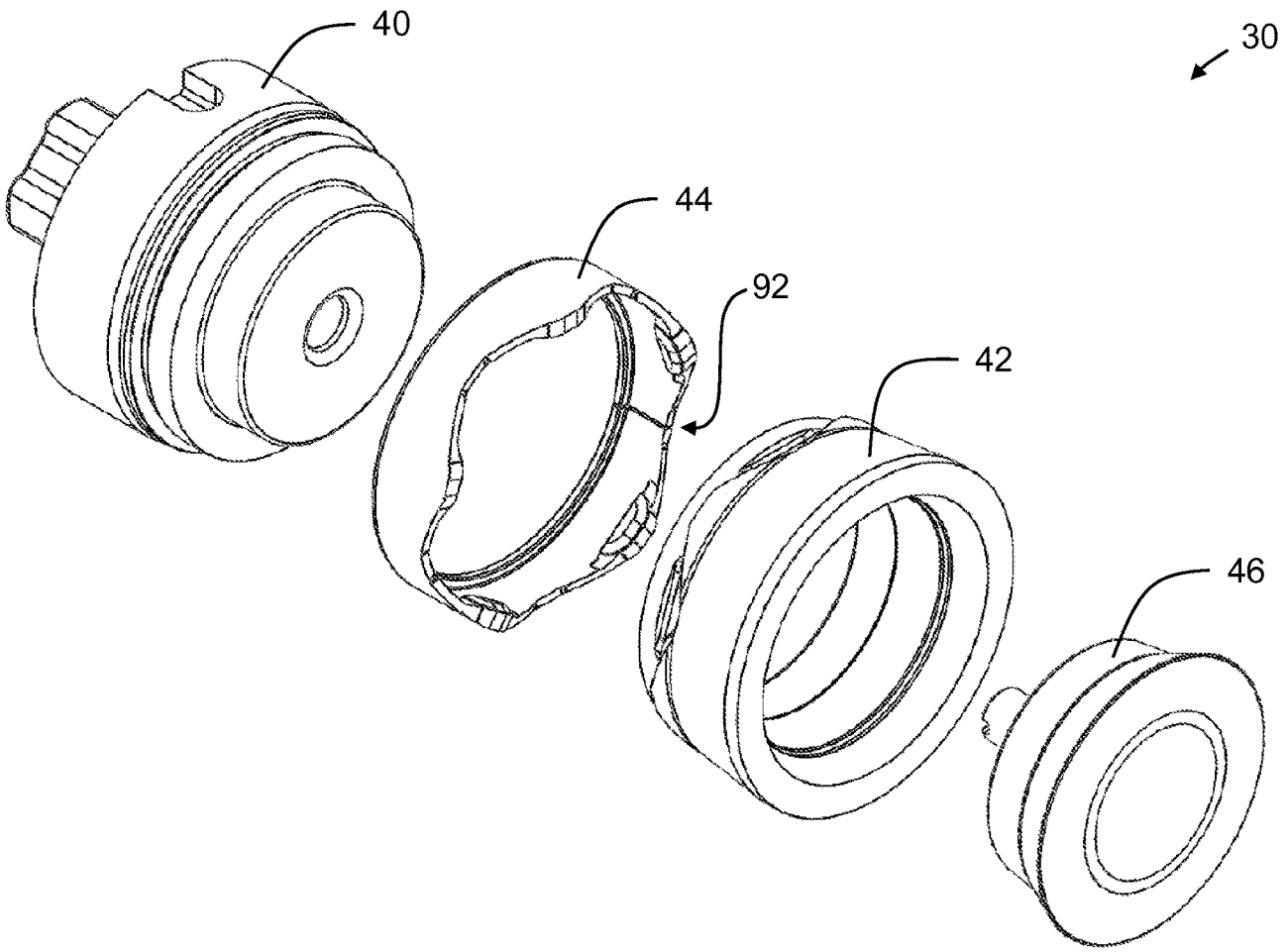
FIG. 3 is an exploded perspective view of the dummy block of FIG. 2.
Figure 4:
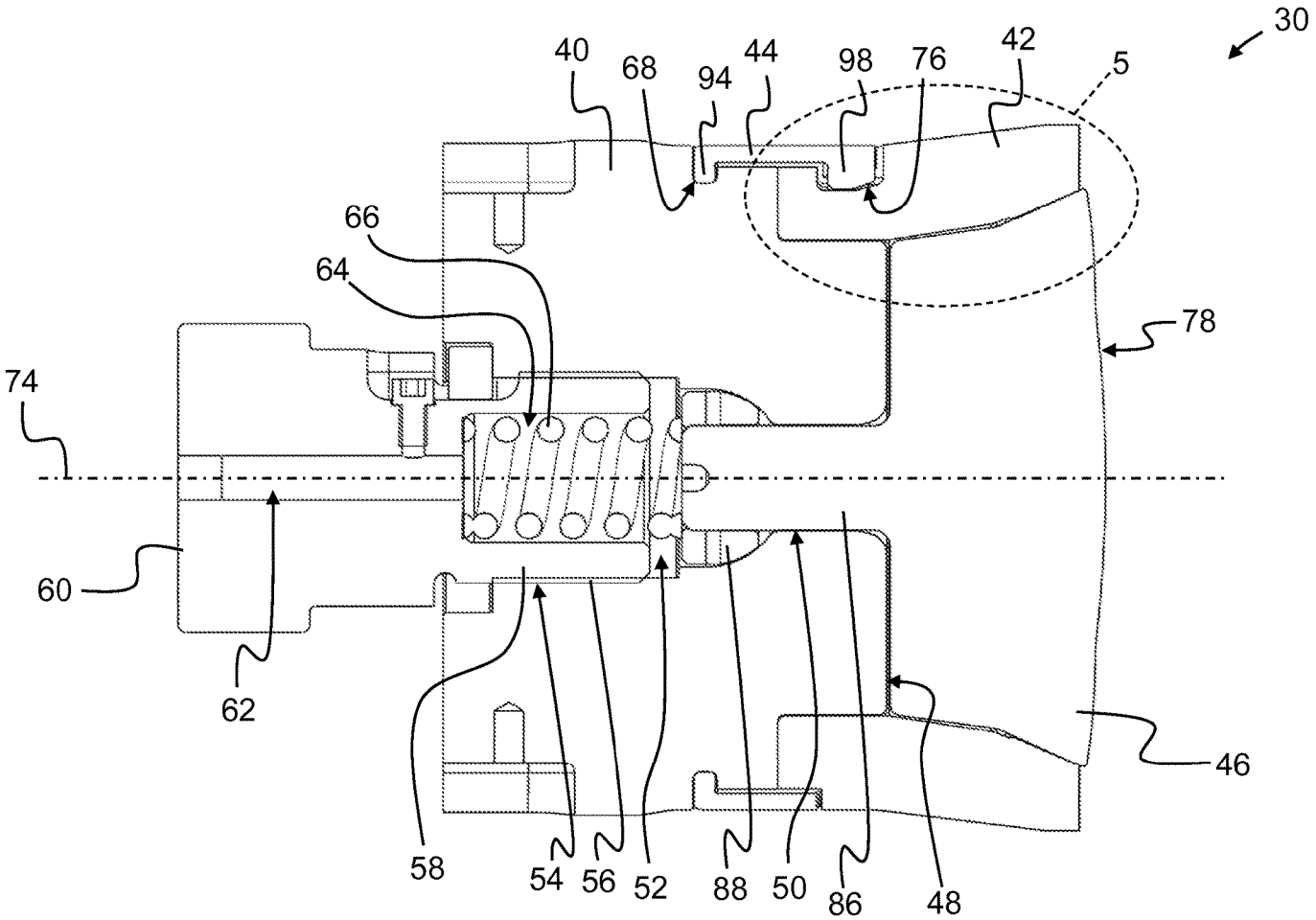
FIG. 4 is a side sectional view of the dummy block of FIG. 2, taken along the indicated section line.

FIG. 1 is a simplified illustration of an extrusion press for use in metal extrusion. The extrusion press comprises a container 20 having an outer mantle 22 that surrounds an inner tubular liner 24. The container 20 serves as a temperature controlled enclosure for a billet 26 during extrusion of the billet. An extrusion ram 28 is positioned adjacent one end of the container 20. The distal end of the extrusion ram 28 has a dummy block 30 coupled thereto, which is configured to abut the billet 26 for advancing the billet through the container 20. An extrusion die 32 is positioned adjacent a die end 34 of the container 20.

During operation, once the billet 26 is heated to a desired extrusion temperature (typically 800-900° F. for aluminum), it is delivered to the extrusion press. The extrusion ram 28 with the dummy block 30 coupled thereto are then advanced, so as to push the billet 26 through the container 20 and towards the extrusion die 32. Under the pressure exerted by the advancing extrusion ram 28 and dummy block 30, the billet 26 is extruded through the profile provided in the extrusion die 32 until all or most of the billet material is pushed out of the container 20, resulting in the extruded product 36.

The dummy block 30 may be better seen in FIGS. 2 to 5. Dummy block 30 comprises a dummy block base 40, a replaceable collar 42 seated against the dummy block base 40 and coupled thereto by an outer connecting ring 44, and a moveable plunger 46 positioned forward of the dummy block base 40 and within the collar 42. The moveable plunger 46 is configured to move rearwardly when the dummy block 30 abuts a billet 26 during use, which in turn causes the collar 42 to expand.

The dummy block base 40 comprises a generally cylindrical body having a planar forward surface 48. The dummy block base 40 also comprises a center bore 50 extending from the planar forward surface 48 to a central recess 52. The dummy block base 40 has a plurality of threads 54 formed on an interior surface defining the central recess 52, and which are configured to engage complimentary outer threads 56 formed on an exterior surface of a stem 58 of a stud 60 or other elongate projection. The stud 60 or other elongate projection is mounted on a forward end of the extrusion ram 28, and comprises an internal conduit 62 that is configured to convey cooling fluid from a cooling fluid source into the central recess 52. In this embodiment, the cooling fluid is air. The stem 58 has a central recess 64 for accommodating a spring 66 that is configured to provide a biasing force urging the moveable plunger 46 away from the from the planar forward surface 48 of the dummy block base 40. The dummy block base 40 also has a circumferential groove 68 formed on an outer surface thereof for engaging the outer connecting ring 44.

The replaceable collar 42 comprises a generally annular body having a first conical inner surface 70, and a second conical inner surface 72 adjacent the first conical inner surface 70. The first and second conical inner surfaces 70 and 72 are inclined relative to the center axis 74 of the dummy block 30, such that the first conical inner surface 70 and the second conical inner surface 72 each define a first angle and a second angle, respectively, with the center axis 74. The collar 42 has a plurality of recesses 76 formed on an outer surface thereof for engaging the connecting ring 44. In this embodiment, the collar 42 has five (5) recesses 76.

Figure 5:
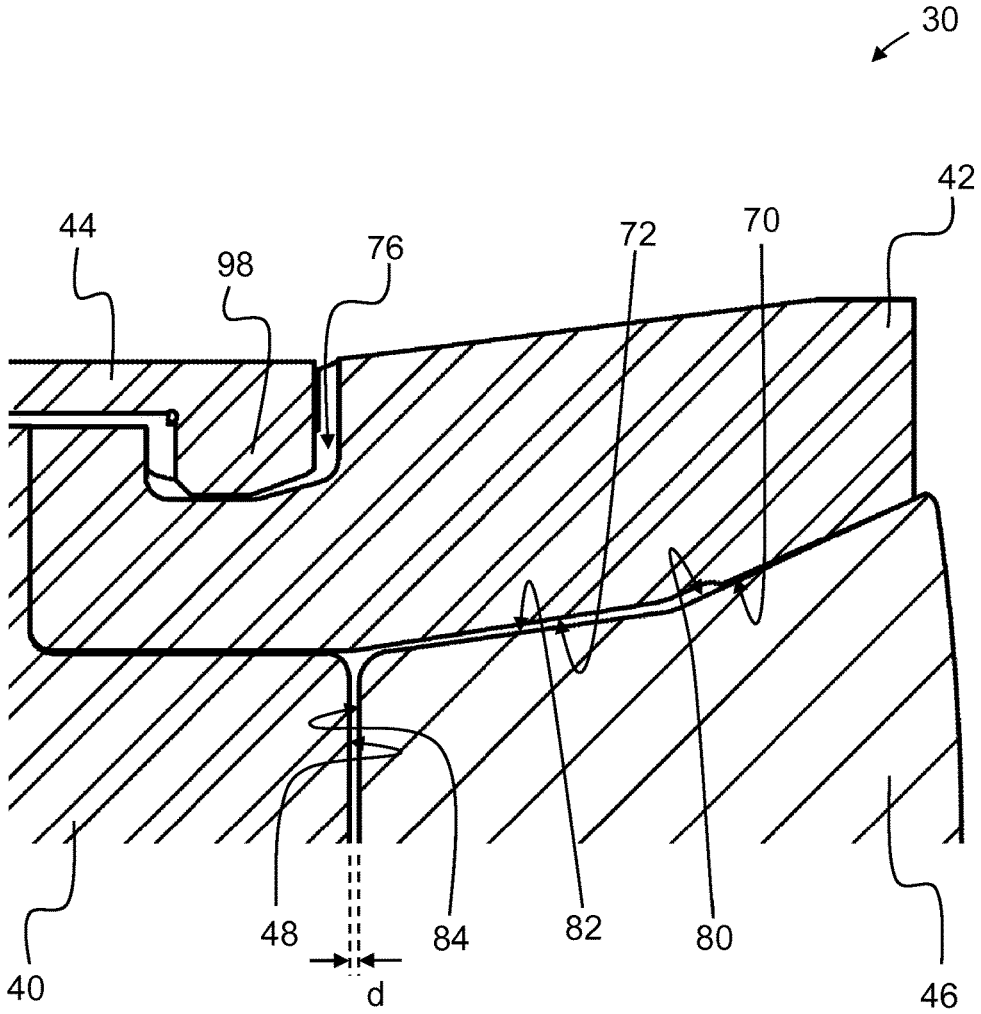
FIG. 5 is an enlarged fragmentary view of the dummy block of FIG. 4 identified by reference numeral 5.

The plunger 46 has a convex forward face 78 that is configured to abut the billet 26. The plunger 46 also has a first conical outer surface 80 adjacent the convex face 78, and a second conical outer surface 82 adjacent the first conical outer surface 80. The first and second conical outer surfaces 80 and 82 are inclined relative to the center axis 74 of the dummy block 30, such that the first conical outer surface 80 and the second conical outer surface 82 each define a third angle and a fourth angle, respectively, with the center axis 74. The plunger also has a planar rear surface 84 that is configured to abut against the forward surface 48 of the dummy block base 40. Extending rearwardly from the rear surface 84 is a post 86 that is shaped to extend through the center bore 50 and into the central recess 52 of the dummy block base 40. A connector 88 is fastened to a distal end of the post 86 within the central recess 52 for coupling the moveable plunger 46 to the dummy block base 40, and for providing a surface against which the spring 66 abuts. As shown in FIG. 5, the plunger 46 is shaped such that the planar rear surface 84 and the planar forward surface 48 are spaced by a distance "d" when the moveable plunger 46 is not pressed against the dummy block base 40.

The third angle defined by first conical outer surface 80 and the center axis 74 is slightly greater than the first angle defined by the first conical inner surface 70 and the center axis 74, so as to ensure that the plunger 46 and the collar 42 do not become jammed during use. In the embodiment shown, the difference between the third angle and the first angle is about 1.5 degrees. As will be understood, if the angle of inclination of the first conical outer surface 80 were the same as, or less than, the angle of inclination of the first conical inner surface 70, these surfaces would jam as the plunger moves rearwardly into the collar 42 such that when the dummy block is removed from the container, the spring 66 would not have sufficient force to return the plunger 46 to its initial position.

The connecting ring 44 has a generally annular shape, and has a cut 92 therethrough for allowing the connecting ring 44 to be expanded during assembly and disassembly of the dummy block 30, and for allowing the connecting ring 44 to expand as needed during use. The connecting ring 44 comprises an inwardly extending rib 94 that is configured to engage the circumferential groove 68 of the dummy block base 40. The connecting ring 44 also comprises a plurality of inwardly extending fingers 98, with each finger 98 being shaped to engage a respective recess 76 on the outer surface of the collar 42. In this embodiment, the connecting ring 44 comprises five (5) inwardly extending fingers 98.

During use, the extrusion ram 28 with the assembled dummy block 30 mounted thereon is advanced through a container 20 to force the billet 26 through the extrusion die 32. A forward force is applied by the extrusion ram 28 to the billet 26 via the dummy block 30. In return, an opposing force is applied by the billet 26 to the dummy block 30, which causes the plunger 46 to move rearward toward the dummy block base 40. During this rearward motion, the plunger 46 applies pressure against the first conical inner surface 70 and the second conical inner surface 72 of the collar 42, causing the collar 42 to expand outwardly to accommodate the plunger 46. The connecting ring 44 in turn expands circumferentially from the axial cut 92 to accommodate the expanding collar 42. The plunger 46 continues to move rearwardly toward the dummy block base 40 and to expand the collar 42 until the planar rear surface 84 of the plunger 46 abuts against the planar forward surface 48 of the dummy block base 40. With the dummy block base 40 and plunger 46 abutting in this manner, the force applied by the extrusion ram 28 can be transferred directly through the core of the dummy block 30 to the billet. At the end of the stroke, the extrusion ram 28 with the dummy block 30 mounted thereon is returned to its starting position in the container 20 to receive the next billet. With the opposing force previously applied by the billet 26 now removed, the spring 66 pushes the plunger 46 forward to its initial position, which in turn causes both the collar 42 and the connecting ring 44 to contract to their original sizes.

As will be appreciated, the configuration of the dummy block 30, and in particular the coupling of the dummy block base 40 and the collar 42 by the connecting ring 44, eliminates the need for bulky features that would otherwise be needed for a conventional bayonet-style connection. As a result, the contact area between the dummy block base 40 and the plunger 46 (sometimes referred to as "pad area") is advantageously increased, which allows a greater amount of the force applied by the extrusion ram 28 to be transferred through the core of the dummy block 30 to the billet 26, as compared to conventional dummy blocks having bayonet-style connections.

Additionally, and as will be appreciated, the "crown"-shaped configuration of the fingers 98 of the connecting ring 44 advantageously provide a greater cross-sectional area between the connecting ring 44 and the plunger 46, which in turn increases the column strength of the dummy block 30 and allows the dummy block 30 to withstand greater force applied by the extrusion ram 28 during operation without deforming, as compared to conventional dummy blocks.

Further, and as will be appreciated, the "crown"-shaped configuration of the fingers 98 of the connecting ring 44 advantageously allow the feature(s) engaging the collar 42 to have increased thickness in the axial direction for increasing the axial strength of the connecting ring 44, while allowing the connecting ring 44 to remain flexible in the circumferential direction for assembly and disassembly of the dummy block 30.

These features advantageously enable the dummy block 30 to be operated at higher extrusion pressures than conventional dummy blocks.

Although in the embodiment described above, the connecting ring 44 has five (5) fingers and the collar 42 has five (5) corresponding recesses, the number of fingers and corresponding recesses are not limited to five (5) and, in other embodiments, fewer or more fingers and corresponding recesses may alternatively be used while providing increased column strength of the dummy block and while allowing the connecting ring to remain flexible for assembly and disassembly of the dummy block.

Although embodiments have been described above with reference to the accompanying drawings, those of skill in the art will appreciate that variations and modifications may be made without departing from the scope thereof as defined by the appended claims.

What is claimed is:

1. A dummy block for a metal extrusion press comprising:

a base having a first surface;

an expandable collar having a generally annular collar body seated against the base;

a moveable plunger coupled to the base and accommodated by the expandable collar, the moveable plunger having a second surface configured to abut against the first surface of the base; and an outer connecting ring coupling the expandable collar to the base, the connecting ring comprising at least one feature engaging the base and a plurality of fingers engaging the expandable collar, wherein the collar has a plurality of recesses on an outer circumferential surface of said generally annular body, each recess receiving a respective finger extending from the connecting ring.

2. The dummy block of claim 1, wherein each finger is received by a corresponding recess of the expandable collar.

3. A dummy block for a metal extrusion press comprising:

a base having a first surface;

an expandable collar seated against the base;

a moveable plunger coupled to the base and accommodated by the expandable collar, the moveable plunger having a second surface configured to abut against the first surface of the base; and an outer connecting ring coupling the expandable collar to the base, the connecting ring comprising at least one feature engaging the base and a plurality of fingers engaging the expandable collar, wherein the expandable collar has a plurality of recesses, each recess receiving a respective finger extending from the connecting ring, wherein the at least one feature is an inwardly extending circumferential rib.

4. The dummy block of claim 3, wherein the circumferential rib is received by a groove on an outer surface of the base.

5. The dummy block of claim 1, wherein the moveable plunger comprises a convex face configured to abut against a billet during use.

6. The dummy block of claim 1, wherein the base comprises a recess configured to receive a portion of a stud.

7. The dummy block of claim 6, wherein the stud comprises an internal conduit that is configured to convey fluid into the recess for cooling the dummy block.

8. The dummy block of claim 1, wherein the connecting ring comprises a cut extending therethrough.

9. Use of the dummy block of claim 1 in a metal extrusion press for carrying out metal extrusion.

10. An extrusion press comprising the dummy block of claim 1.

11. A dummy block for a metal extrusion press comprising:

a base having a first surface;

an expandable collar seated against the base;

a moveable plunger coupled to the base and accommodated by the expandable collar, the moveable plunger having a second surface configured to abut against the first surface of the base; and an outer connecting ring coupling the expandable collar to the base, the connecting ring comprising at least one feature engaging the base and a plurality of fingers engaging the expandable collar, wherein the expandable collar has a plurality of recesses, each recess receiving a respective finger extending from the connecting ring, wherein each finger is received by a corresponding recess of the expandable collar, wherein the at least one feature is an inwardly extending circumferential rib.

12. The dummy block of claim 11, wherein the circumferential rib is received by a groove on an outer surface of the base.

13. Use of the dummy block of claim 3 in a metal extrusion press for carrying out metal extrusion.

14. A extrusion press comprising the dummy block of claim 3.

15. Use of the dummy block of claim 11 in a metal extrusion press for carrying out metal extrusion.

16. An extrusion press comprising the dummy block of claim 11.

* * * * *